US005582043A

United States Patent [19]

McCue et al.

[11] Patent Number: 5,582,043

[45] Date of Patent: Dec. 10, 1996

[54] GOLF BAG AND CLUB SECURING DEVICE

[76] Inventors: Robert McCue, 281 Floyd Rd., Shirley, N.Y. 11967; Gary McCue, 3686 Bridle Path, Bethpage, N.Y. 11714

[21] Appl. No.: 441,200

[22] Filed: May 15, 1995

[51] Int. Cl.[6] ..... E05B 69/00

[52] U.S. Cl. ..... 70/58; 70/18; 70/19; 206/315.4

[58] Field of Search ..... 70/14, 18, 19, 70/57, 58, 30, 49, 61; 292/256.6, 256.65, 258; 206/315.3, 315.4

[56] References Cited

U.S. PATENT DOCUMENTS

| | | | |
|---|---|---|---|
| 1,562,030 | 11/1925 | Lawrence | 206/315.4 |
| 1,570,510 | 1/1926 | McQuirk . | |
| 1,908,998 | 5/1933 | Mullins . | |
| 1,929,922 | 10/1933 | Adams . | |
| 4,442,937 | 4/1984 | Delauder | 206/315.4 |
| 4,466,259 | 8/1984 | Osgood, Sr. | 70/164 |
| 4,796,789 | 1/1989 | Willcocks . | |
| 4,811,577 | 3/1989 | Webster et al. | 70/58 |
| 4,863,019 | 9/1989 | Lewis et al. | 70/19 |
| 5,004,100 | 4/1991 | Smith | 70/19 |
| 5,119,649 | 6/1992 | Spence | 70/18 |
| 5,131,442 | 7/1992 | Bevier | 206/315.4 |
| 5,406,809 | 4/1995 | Igelmund | 70/18 |

FOREIGN PATENT DOCUMENTS

| | | | |
|---|---|---|---|
| 0006126 | of 1911 | United Kingdom | 206/315.3 |

*Primary Examiner*—Darnell M. Boucher
*Attorney, Agent, or Firm*—Michael I. Kroll

[57] ABSTRACT

A golf bag and club securing device for a golf bag, having a body with an open top and a plurality of club separators at the open top. The securing devices comprises a clip member to slip onto the open rod on the body of the golf bag. Paraphernalia is for retaining the clip member to the body of the golf bag. A structure is for anchoring the clip member with the body of the golf bag to a stationary object, so as to protect the golf bag from theft.

6 Claims, 3 Drawing Sheets

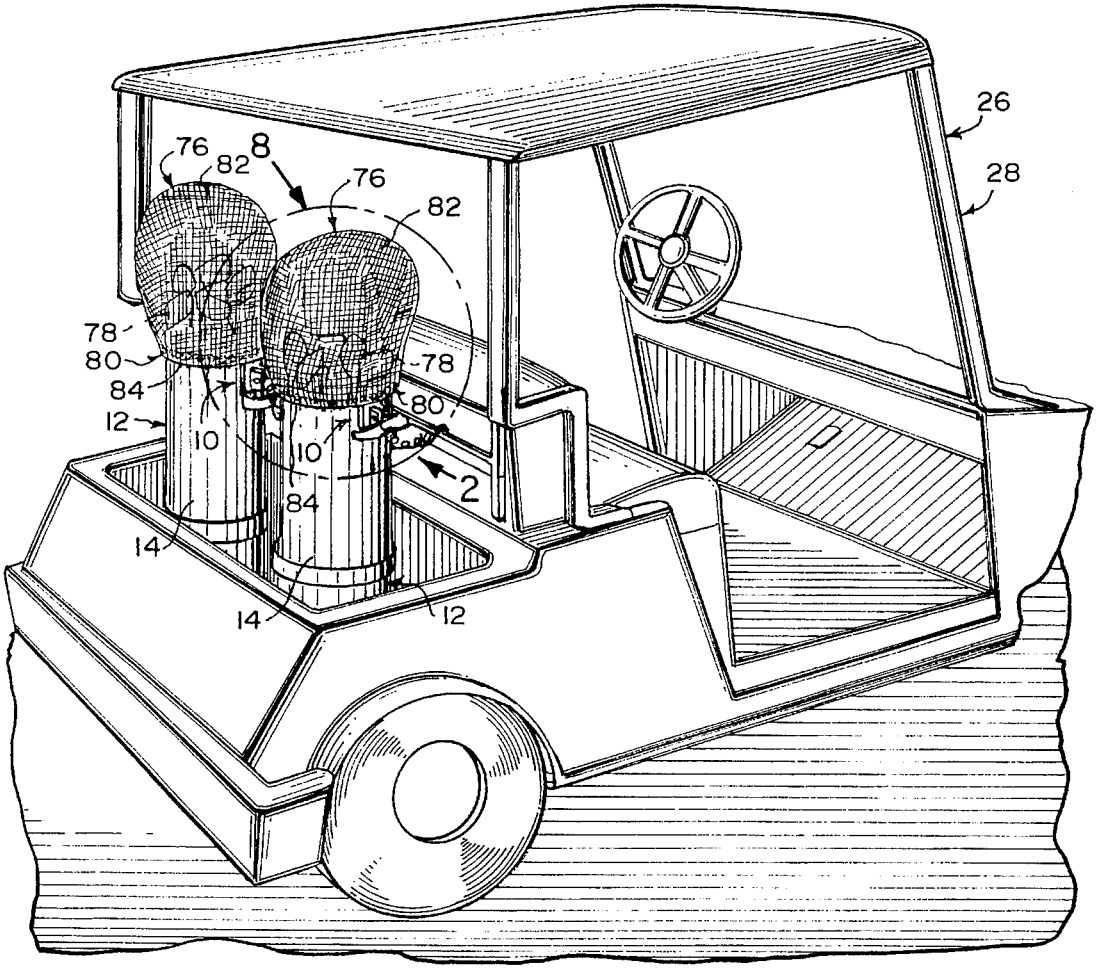
Fig. 1
Fig. 2
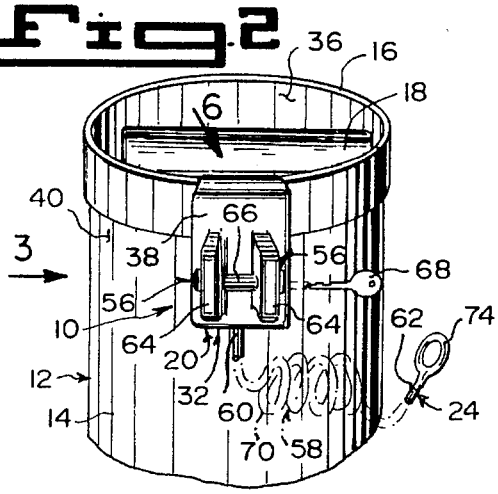
Fig. 3
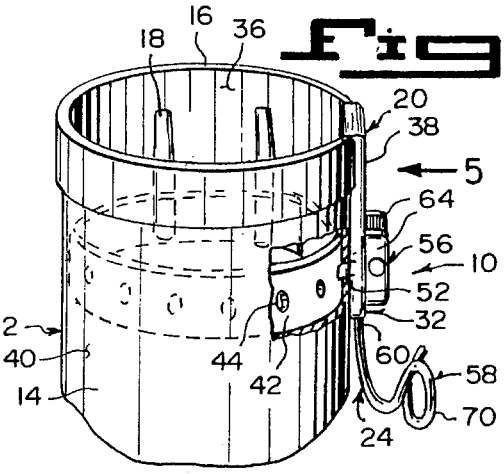

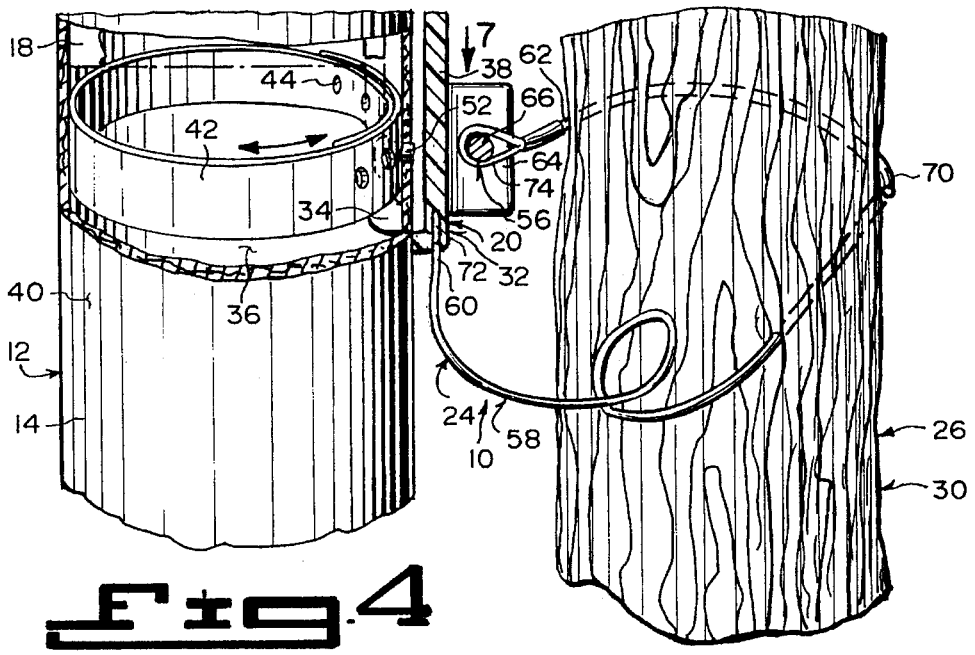
Fig. 4
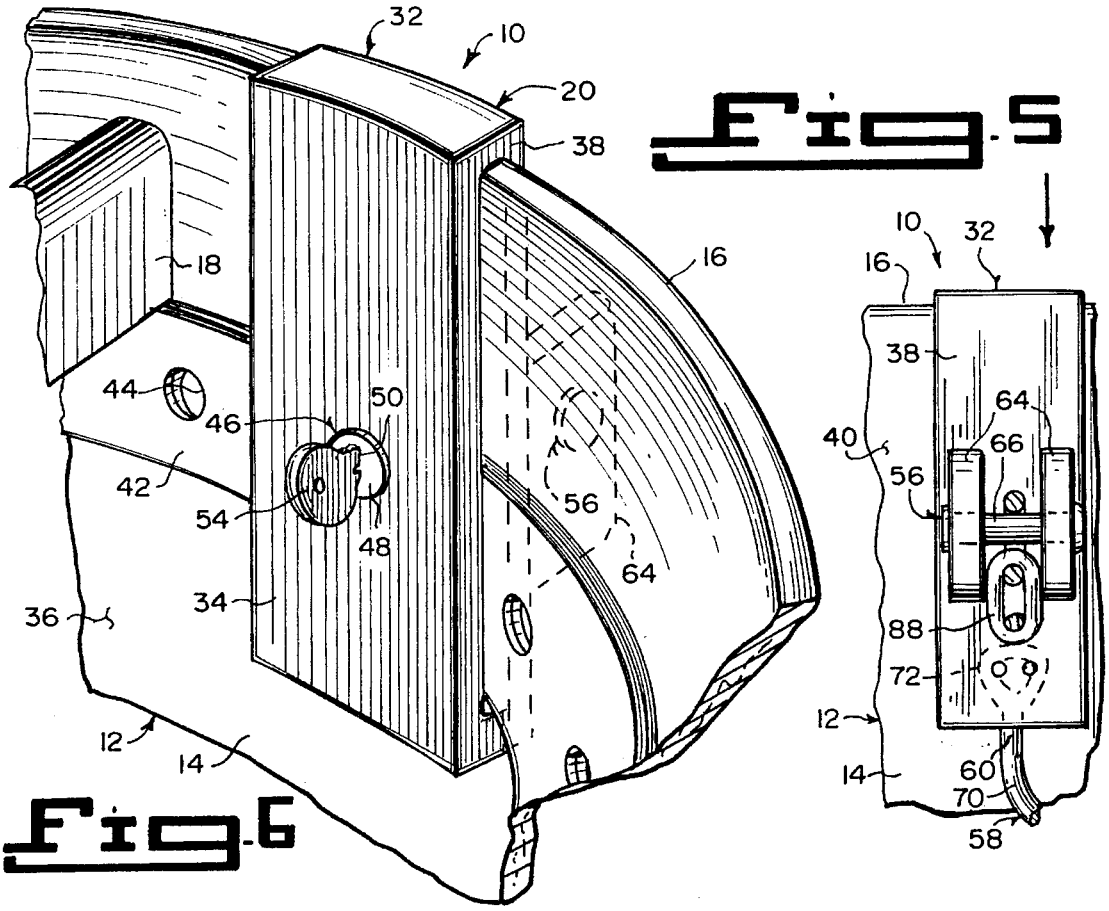
Fig. 5
Fig. 6

GOLF BAG AND CLUB SECURING DEVICE

BACKGROUND OF THE INVENTION

1. Field of the Invention

The instant invention relates generally to golf bags and more specifically it relates to a golf bag and club securing device.

2. Description of the Prior Art

Numerous golf bags have been provided in prior art. For example, U.S. Pat. No. 1,570,510 to McQuirk; U.S. Pat. No. 1,908,998 to Mullins; U.S. Pat. No. 1,928,922 to Adams and U.S. Pat. No. 4,796,789 to Willcocks all are illustrative of such prior art. While these units may be suitable for the particular purpose to which they address, they would not be as suitable for the purposes of the present invention as heretofore described.

U.S. Pat. No. 1,570,510:

A golf bag has a carrying handle near its upper end and a staple below the handle. A closure for the upper end of the bag has a downwardly projecting sleeve to surround the upper portion of the bag. The sleeve has a longitudinal slot which opens through its lower end, to receive the handle. A pair of links are engaged over the staple, for connecting the edges of the slot with each other under the handle.

U.S. Pat. No. 1,908,998:

A golf bag comprising a body. A flexible hood is adapted to extend above the body to a protecting position over golf clubs inserted in the body. A protecting sleeve of flexible material open at its upper and lower ends is attached to the inside of the hood. The opening through the sleeve is parallel to the vertical axis of the body of the bag.

U.S. Pat. No. 1,928,922:

As a new and useful article of manufacture, a removable hood-like golf bag boot has a head and a tubular base. The latter has on its margin one stringer of a separable fastener. The stringer has a runner stop and is slit and separable at one side of the stop. A runner is on the stringer. The head of the boot is longitudinally bifuracted into separable sections above the tubular base, for passage of clubs therethrough when the sections are separated. A means is for connecting the margins of the sections to close the head of the boot.

U.S. Pat. No. 4,796,789:

A golf bag adapted to function as a shoulder carrier for a set of golf clubs or as a locked travel case therefor suitable for air transport. The bag, which is molded of rigid plastic material, has a generally cylindrical form closed at either end. The bag is composed of a semi-cylindrical chest section and a semi-cylindrical lid section hinged thereto. The lid section is divided into a major lid which extends from the bottom end of the bag to an upper level below the top end, and a minor lid which extends from the upper level to the top end. When the minor lid is swung open, the heads of the golf clubs whose long handles rest on the bottom of bag are then accessible for removal. The major and minor lids are provided with raised edge borders which, when the lids are closed, overlie corresponding edges of the chest section. The longitudinal course on the borders of the lids have releasable clamps mounted thereon adapted to engage complementary anchor hooks on the chest section. Only the clamp on the minor lid is lockable, so that it cannot then be released. The circumferential course on the edge border at the lower end of the minor lid overlies the adjacent border course on the major lid. when the minor lid is locked, this effectively acts to lock the major lid, which cannot be swung open without first unlocking the minor lid.

SUMMARY OF THE INVENTION

A primary object of the present invention is to provide a golf bag and club securing device that will overcome the shortcomings of the prior art devices.

Another object is to provide a golf bag and club securing device having a clip member that can be retained to the golf bag, so that the clip member with the golf bag can be anchored to any stationary object, such as a tree, protecting the golf bag from theft.

An additional object is to provide a golf bag and club securing device in which a cover can be placed over the top of the golf clubs in the golf bag and connected to the clip member to prevent removal of the cover, so as to keep the golf clubs within the golf bag and stop the theft of the golf clubs.

A most important object is that the instant device is an accessary to most existing golf bags so that the device may easily be added to existing golf bags.

A further object is to provide a golf bag and club securing device that is simple and easy to use.

A still further object is to provide a golf bag and club securing device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a golf cart with parts broken away, showing the instant invention in use anchoring two golf bags thereto.

FIG. 2 is a front perspective view taken in the direction of arrow 2 in FIG. 1, with the bottom portion of the golf bag broken away, the golf clubs and the cover removed therefrom.

FIG. 3 is a side perspective view taken in the direction of arrow 3 in FIG. 2, with the upper portion of the golf bag broken away.

FIG. 4 is a side perspective view with parts broken away and in section, showing the clip member with the golf bag anchored to a stationary object, such as a tree.

FIG. 5 is a front elevational view taken in the direction of arrow 5 in FIG. 3, with parts broken away and in section.

FIG. 6 is a rear perspective view taken in the direction of arrow 6 in FIG. 2, with parts broken away and in section.

Similar reference characters denote corresponding features consistently throughout the attached drawings.

DETAILED DESCRIPTION OF THE PREFERRED EMBODIMENTS

Figure 7:
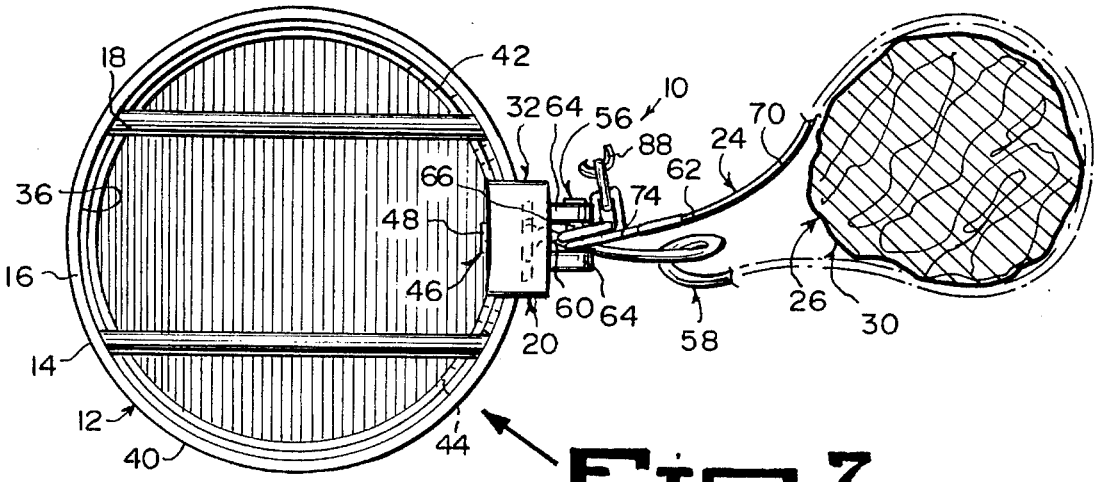
FIG. 7 is a top view taken in the direction of arrow 7 in FIG. 4.

Turning now descriptively to the drawings, in which similar reference characters denote similar elements throughout the several views, FIGS. 1 through 8 illustrate a golf bag and club securing device 10 for a golf bag 12, having a body 14 with an open top 16 and a plurality of club separators 18 at the open top 16. The securing device 10 comprises a clip member 20, to slip onto the open top 16 on the body 14 of the golf bag 12. Paraphernalia is for retaining the clip member 20 to the body 14 of the golf bag 12. A structure 24 is for anchoring the clip member 20 with the body 14 of the golf bag 12 to a stationary object 26, so as to protect the golf bag 12 from theft. The stationary object 26 can be a golf cart 28 shown in FIG. 1, or a tree 30 shown in FIGS. 4 and 7.

The clip member 20 is a generally inverted U-shaped housing 32 that includes a rear leg 34 extending down an inner surface 36 of the body 14 from the open top 16. A front leg 38 extends down an outer surface 40 of the body 14 from the open top 16.

The retaining paraphernalia consists of an adjustable band 42, having a plurality of spaced apart holes 44 therethrough. The adjustable band 42 will fit about the inner surface 36 of the body 14 below the club separators 18 adjacent the open top 16. A first lock assembly 46 in the rear leg 34 of the clip member 20, extends through two aligned holes 44 in overlapping portions of the adjustable band 42, so as to retain the clip member 20 to the golf bag 12.

The first lock assembly 46 contains a cylinder 48 having a keyway 50 carried in the clip member 20. A pin shaft 52 is extendable from a rear portion of the cylinder 48. A key 54 fits into the keyway 50 of the cylinder 48, which when operated will cause the pin shaft 52 to project into the two aligned holes 44 in the overlapping portions of the adjustable band 42.

The anchoring structure 24 includes a second lock assembly 56 on the front leg 38 of the clip member 20. A lanyard 58 is provided, having a first end 60 affixed to the front leg 38 of the clip member 20. The lanyard 58 can extend about the stationary object 26 with a second end 62 connectable to the second lock assembly 56.

The second lock assembly 56 includes a pair of lugs 64 extending from the front leg 38 of the clip member 20. A lock shaft 66 having a keyway is carried between the lugs 64. A key 68 fits into the keyway of the lock shaft 66, which when operated will cause the lock shaft 66 to lock between the lugs 64.

The lanyard 58 is a strong cable wire 70 with a first loop 72 at a first end and a second loop 74 at a second end. The first loop 72 is affixed into the front leg 38 of the clip member 20 and the second loop 74 is connectable to the second lock assembly 56.

The strong cable wire 70 is normally in a coiled configuration which can be extended, so that the second loop 74 can connect to the second lock assembly 56. When the second loop 74 is disconnected from the second lock assembly 56, the strong cable wire 70 will recoil back to its original coiled configuration.

Figure 8:
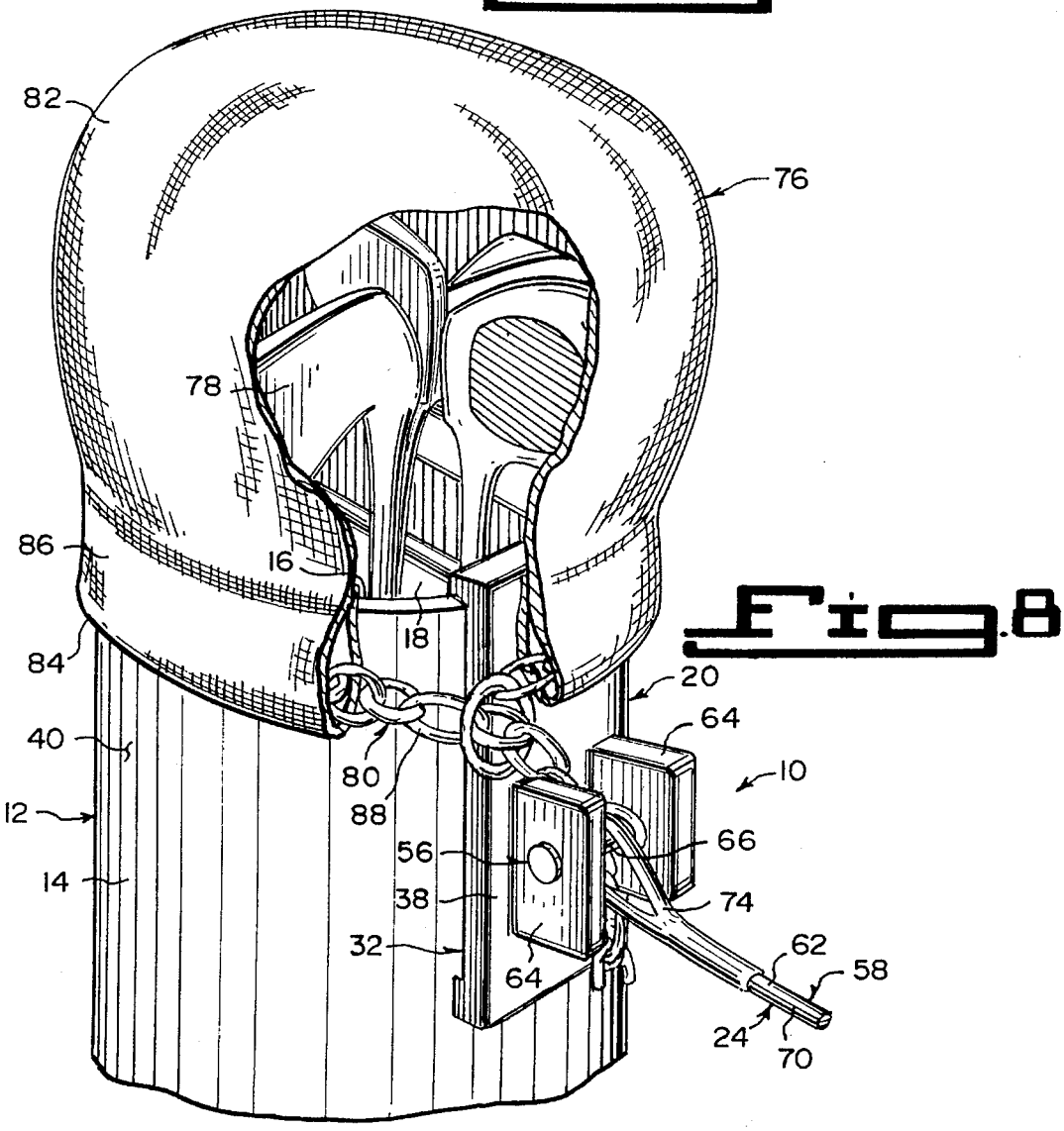
FIG. 8 is an enlarged perspective view as indicated by arrow 8 in FIG. 1, with the cover broken away.

The golf bag and club securing device 10, as shown in FIG. 1 and 8, further includes a cover 76 to fit over golf clubs 78, which are inserted through the open top 16 between the club separators 18 and into the body 14 of the golf bag 12. An assembly 80 is for holding the cover 76 snugly about the open top 16 of the body 14 and to the second lock assembly 56 of the clip member 20, so as to protect the golf clubs 78 from the theft by preventing removal of the golf clubs 78 from the golf bag 12. The cover 76 is a flexible hood 82 with a mouth 84, which extends about the open top 16 of the body 14 of the golf bag 12.

The holding assemblage 80 consists of the flexible hood 82 having a hem 86 formed about the mouth 84. A chain 88 extends through the hem 86. The chain 88 interlocks together at a first end to pull the hem 86 taut about the open top 16 of the body 14 of the golf bag 12. A second end of the chain 88 can engage with the second lock assembly 56 of the anchoring structure 24 on the clip member 20, to keep the flexible hood 82 in place on the golf bag 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A golf bag and club securing device for a golf bag having a body with an open top and a plurality of club separators at the open top, said securing device comprising:

a) a clip member to slip onto the open top on the body of the golf bag, said clip member being an inverted U-shaped housing that includes a rear leg extending down an inner surface of the body from the open top, and a front leg extending down an outer surface of the body from the open top;

b) means for retaining said clip member to the body of the golf bag, said retaining means including an adjustable band, having a plurality of spaced apart holes therethrough, whereby said adjustable band will fit about the inner surface of the body below the club separators adjacent the open top, and a first lock assembly in said rear leg of said clip member, which extends through two aligned holes in overlapping portions of said adjustable band, so as to retain said clip member to the golf bag, said first lock assembly including a cylinder having a keyway carried in the said rear leg of said clip member, a pin shaft extendable from a rear portion of said cylinder, and a key to fit into the keyway of said cylinders, which when operated will cause said pin shaft to project into the two aligned holes in the overlapping portions of said adjustable band; and c) means for anchoring said clip member with the body of the golf bag to a stationary object, so as to protect the golf bag from theft, said anchoring means including a second lock assembly on said front leg of said clip member, and a lanyard having a first end affixed to said front leg of said clip member, so that said lanyard can extend about the stationary object with a second end connectable to said second lock assembly, said second lock assembly including a pair of lugs extending from said front leg of said clip member, a lock shaft having a keyway carried between said lugs, and a key to fit into the keyway of said lock shaft, which when operated will cause said lock shaft to lock between said lugs.

2. A golf bag and club securing device as recited in claim 1, wherein said lanyard is a strong cable wire with a first loop at a first end and a second loop at a second end, in which the first loop is affixed into said front leg of said clip member and the second loop is connectable to said second lock assembly.

3. A golf bag and club securing device as recited in claim 2, wherein said strong cable wire is normally in a coiled configuration which can be extended, so that the second loop can connect to said second lock assembly and when said second loop is disconnected from said second lock assembly, said strong cable wire will recoil back to its original coiled configuration.

4. A golf bag and club securing device as recited in claim 3, further including:

a) a cover to fit over golf clubs which are inserted through the open top between the club separators and into the body of the golf bag; and b) means for holding said cover snugly about the open top of the body and to the second lock assembly of said clip member, so as to protect the golf clubs from the theft by preventing removal of the golf clubs from the golf bag.

5. A golf bag and club securing device as recited in claim 4, wherein said cover is a flexible hood with a mouth, which extends about the open top of the body of the golf bag.

6. A golf bag and club securing device as recited in claim 5, wherein said holding means includes:

a) said flexible hood having a hem formed about the mouth; and b) a chain extending through said hem, said chain interlocks together at a first end to pull said hem taut about the open top of the body of the golf bag, so that a second end of said chain can engage with said second lock assembly of said anchoring means on said clip member to keep said flexible hood in place on the golf bag.

* * * * *